US005867865A

United States Patent [19]

Obermüller et al.

[11] Patent Number: 5,867,865

[45] Date of Patent: Feb. 9, 1999

[54] FILTERLESS INDUSTRIAL VACUUM CLEANER OPERATED BY COMPRESSED GAS AND SUITABLE FOR CONNECTION TO AN EXISTING SUCTION AND FILTERING SYSTEM

[75] Inventors: Herbert J. Obermüller; Ulrich H. Kethers, both of Linsengericht, Germany

[73] Assignee: T.E.T.-Umwelttechnik Gesellschaft für Lufttechnische Verfahren mbH, Germany

[21] Appl. No.: 687,501

[22] PCT Filed: Jan. 24, 1995

[86] PCT No.: PCT/EP95/00243

§ 371 Date: Jul. 17, 1996

§ 102(e) Date: Jul. 17, 1996

[87] PCT Pub. No.: WO95/19730

PCT Pub. Date: Jul. 27, 1995

[30] Foreign Application Priority Data

Jan. 25, 1994 [DE] Germany ..... 94 01 201 U

[51] Int. Cl.[6] ..... A47L 5/16

[52] U.S. Cl. ..... 15/409; 15/339

[58] Field of Search ..... 15/339, 409; 137/892; 251/149.8; 417/151, 181, 187, 188

[56] References Cited

U.S. PATENT DOCUMENTS

| | | | |
|---|---|---|---|
| 4,419,783 | 12/1983 | Steffen | 15/339 |
| 5,454,139 | 10/1995 | Beck | 15/409 |

FOREIGN PATENT DOCUMENTS

| | | | |
|---|---|---|---|
| 440599 | 7/1912 | France | 417/187 |
| 75983 | 7/1961 | France | 417/151 |
| 2701830 | 9/1994 | France . | |
| 3717569 | 7/1988 | Germany . | |

*Primary Examiner*—Terrence Till
*Attorney, Agent, or Firm*—Bierman, Muserlian and Lucas

[57] ABSTRACT

A device for extraction of vacuum-cleaned material comprising a propellant nozzle (1) operated by propellant gas that has on a suction side a vacuum tube (4) with vacuum tool (20) on the end for extraction of vacuum cleaned material and on a discharge side is connected to an extraction pipe (9) leading to a suction and filtering system, wherein means (5,6) to automatically trigger a function switching on said propellant nozzle (1) when said vacuum tool (20) is removed from its rest position and that automatically trigger a function switching off said propellant nozzle (1) when said vacuum tool (20) is inserted in its res position into a mounting (7) into which a plunger (6) of a valve (5) controlling the propellant gas slidably projects.

2 Claims, 1 Drawing Sheet

FILTERLESS INDUSTRIAL VACUUM CLEANER OPERATED BY COMPRESSED GAS AND SUITABLE FOR CONNECTION TO AN EXISTING SUCTION AND FILTERING SYSTEM

FIELD OF THE INVENTION

The invention relates to a device for extraction of vacuum-cleaned material by means of a propellant nozzle operated by propellant, which has on the suction side a vacuum tube with vacuum tool on the end for extraction of the vacuum-cleaned material and on the discharge side is connected to a waste air pipe leading to a suction and filtering system.

STATE OF THE ART

Industrial companies generally use mobile industrial vacuum cleaners. Stationary vacuum cleaners are also used occasionally, usually attached to a longer vacuum tube and having several "sockets" for vacuum cleaner tools. Both vacuum cleaners have their own filters, which must be periodically cleaned or replaced. A suction fan—on the clean air side, i.e. operating behind the filter—generates the necessary vacuum pressure and the suction volume.

Drawbacks of industrial vacuum cleaners are their limited filter surface, leading to more frequent cleaning and changes, the high expense locally of obtaining a vacuum cleaner and making it available to others in a clean condition after use, the bulkiness of these vacuum cleaners, and the hindrances this presents.

In addition, the vacuum cleaner emits air and thereby creates air turbulences that can swirl up dust.

These arguments and the generally low number of cleaners present in a factory explain the frequent lack of acceptance of the industrial vacuum cleaner in factories.

A device of the type mentioned at the outset is described in DE 37 17 569 C1. In order to remove vacuum-cleaned material via the vacuum tool or a vacuum tube connected to the latter, the vacuum tube leads either to a fan or to a Venturi nozzle from which extends a compressed air line for supplying propellant and capable of being shut off to the required extent by a cock.

To make use of the known device, not only the vacuum tool but also either a special switch for the fan or the cock for the propellant gas supplied to the Venturi nozzle must be operated.

The object underlying the present invention is to design a device of the type mentioned at the outset such that problem-free handling is assured, in particular that an operation of the propellant nozzle is possible by operation of the vacuum tool without additional manipulation being necessary.

SUMMARY OF THE INVENTION

The object is attained in accordance with the invention in that means are provided that automatically trigger a function switching on the propellant nozzle when the vacuum tool is removed from its rest position and that automatically trigger a function switching off the propellant nozzle when the vacuum tool is placed in its rest position.

By the teachings in accordance with the invention, a compact device for extraction of vacuum-cleaned material is provided that virtually permits one-hand operation, since simply picking up or replacing the vacuum tool supplies or shuts off propellant gas to/from the propellant nozzle. In particular, no additional units such as valves or fans are necessary for removing the vacuum-cleaned material. This in turn means that the device is easy to maintain.

Embodiments of the invention are described in the subclaims.

The invention is described in greater detail on the basis of a design example to be found in the drawing.

BRIEF DESCRIPTION OF THE DRAWINGS

In the sole FIGURE, a device 20 for extraction of vacuum-cleaned material by means of a propellant nozzle operated by propellant gas is shown, for supplying the vacuum-cleaned material via said propellant nozzle to a extraction pipe 9 that can lead to a filter system.

The nozzle 1, which is a ring gap nozzle, is connected via a pipe 4 to a vacuum tube 20.1 having the function of a vacuum tool 20 and having on the end a suction opening 8. The vacuum tool 20/vacuum tube 20.1 with its suction opening 8 can be slid into a tool mounting into which projects a valve plunger 6 of a valve 5. Propellant gas flows via the valve 5 and a connection 10.1 to the gap 2 of the nozzle 1 in order to extract vacuum-cleaned material when the vacuum tool is operated. The nozzle 1 is automatically opened when the vacuum tool 20 is taken out of the tool mounting 7. Conversely, the valve 5 is closed by the pushing back of the valve plunger 6 when the vacuum tube 20.1 is slid into the opening 7.1 of the tool mounting 7.

Figure 1:
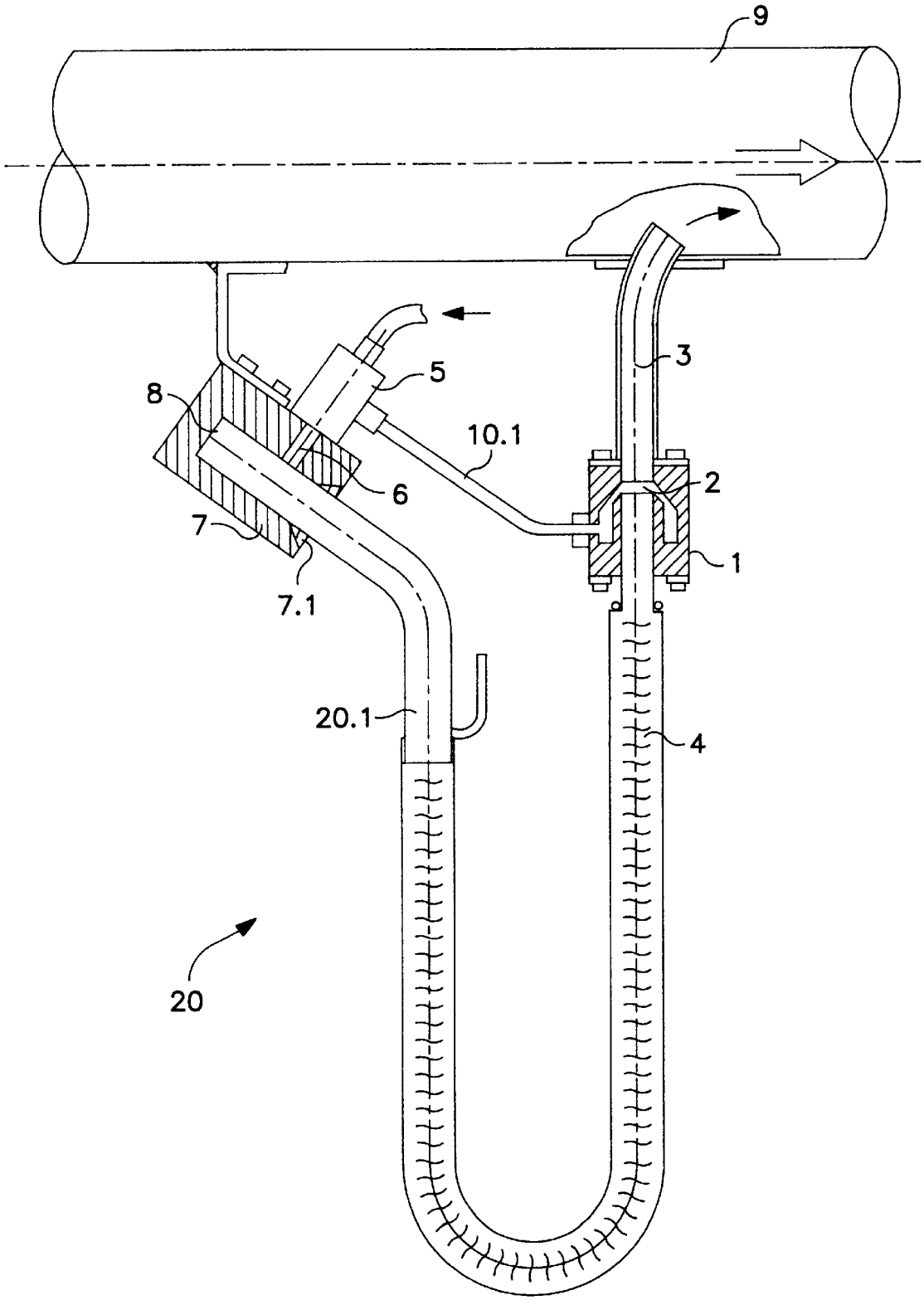

The tube 3 leading from the valve 5 to the extraction pipe 9 opens into the latter such that the vacuum-cleaned material is blown inwards in the flow direction during operation.

Although in the embodiment only one vacuum tool 20 is connected to the extraction pipe 9, in practice a number of vacuum tools can be connected to a single extraction pipe 9, such that the advantages achievable by the teachings in accordance with the invention are assured, these being among others:

- a vacuum tool costs only a fraction of the price of an industrial vacuum cleaner,
- installation is possible at the place where operation is required,
- suspended assembly with a small attachment is possible, so that the vacuum tool does not get in the way.
- cleaning of the vacuum-cleaned air meets the most stringent requirements, i.e. those that are also imposed on the cleaning of process waste air,
- the connection to a process air extraction system makes it generally immaterial whether one or more vacuum tools are in operation simultaneously, since the waste air generated is low in comparison with the process waste air,
- the suction force can be varied by the setting of the propellant nozzle (1),
- problem-free retrofitting in existing extraction pipes is possible, also several vacuum tools can be used for workplace,
- by interconnection of the suction system operation with the compressed air value (5) it can be ensured that no suction takes place when the extraction system is stopped.

What is claimed is:

1. A device for extraction of vacuum-cleaned material comprising a propellant nozzle (1) operated by propellant gas that has on a suction side a vacuum tube (20.1) connected on one end with vacuum tool (20) for extraction of vacuum-cleaned material and is connected on a discharge side to an extraction pipe (9) leading to a suction and filtering system, wherein, means (5,6) to automatically trigger a function switching on said propellant nozzle (1) when said vacuum tool (20) is removed from its rest position when there is no vacuum and that automatically trigger a function switching off said propellant nozzle (1) when said vacuum (20) is inserted in its rest position into a mounting (7) and a plunger (6) of a valve (5) controlling the propellant gas slidably projects into the mounting (7).

2. A device according to claim 1, wherein said propellant nozzle (1) is of the ring gap or ring hole type.

* * * * *